United States Patent [19]

Richards

[11] Patent Number: 4,979,785

[45] Date of Patent: Dec. 25, 1990

[54] MOUNTING SYSTEM PROVIDING READY ACCESS TO SPACE UTILIZING STORAGE UNIT AND SPACE UTILIZING STORAGE UNIT

[76] Inventor: Norman R. Richards, 80 Main St., Berlin, N.H. 03070

[21] Appl. No.: 336,818

[22] Filed: Apr. 13, 1989

[51] Int. Cl.[5] ..... A47B 53/00

[52] U.S. Cl. ..... 312/201; 312/242; 312/246

[58] Field of Search ..... 312/321, 5, 269, 325, 312/266, 246, 248, 201, 275, 242

[56] References Cited

U.S. PATENT DOCUMENTS

| | | | |
|---|---|---|---|
| 264,750 | 9/1882 | Potts | 312/325 X |
| 922,498 | 5/1909 | Merritt | 312/269 X |
| 1,992,435 | 2/1935 | Labadie | 312/201 X |
| 2,589,370 | 3/1952 | Grennan | 312/248 X |
| 4,709,971 | 12/1987 | Leeds et al. | 312/201 |

FOREIGN PATENT DOCUMENTS

| | | | |
|---|---|---|---|
| 304878 | 12/1929 | United Kingdom | 312/301 |

*Primary Examiner*—Joseph Falk

*Attorney, Agent, or Firm*—Herbert L. Gatewood

[57] ABSTRACT

A mounting system is provided for use in supporting a plurality of members to provide support for or storage of a plurality of relatively small items in a compact space. The mounting system provides ready access to any one of such members and to any one of those items supported or stored for servicing or removal. The mounting system finds application for use with storage compartments and also for use with support panels for the support and mounting of items such as electronic components in a compact area to provide ready and easy access thereto for replacement or servicing. A plurality of storage compartments or planar support members are hingedly connected one to the other so as to be foldable one against the other and unfolded to a desired extended position whereby to provide a storage or support unit. The mounting system provides support for the storage unit and includes appropriate linkage connected to the storage compartments or planar-like support members whereby to cause the folding and unfolding action, as desired.

20 Claims, 5 Drawing Sheets

MOUNTING SYSTEM PROVIDING READY ACCESS TO SPACE UTILIZING STORAGE UNIT AND SPACE UTILIZING STORAGE UNIT

BACKGROUND OF THE INVENTION (a) Field of the Invention

This invention relates, in general, to a mounting system for use in limited space applications with support or storage means for support or storage of a multiple number of individual items and to a support or storage unit comprising a plurality of interconnected storage compartments or support members. The mounting system more specifically comprises a mounting assembly and linkage system for mounting a space utilizing unit comprising a plurality of individual storage compartments or planar-like support members capable of being folded one against the other into a compact unit or unfolded in extended fashion at suitable angles one to the other. More particularly, in accordance with a preferred embodiment of the invention, the invention comprises an easy access storage unit comprising a plurality of individual storage compartments connected one to the other, the storage unit being suitable for use where space is limited yet ready access to each of the items stored is desired In a still more particular aspect, the invention relates to a vertically disposed, space utilizing storage unit suitable for use in a vertically disposed enclosure which defines a vertically disposed internal storage space, access to which is provided by a vertically disposed front opening.

(b) Description of the Prior Art

Storage space in homes, in closets and cabinets, and in appliances such as refrigerators, is often less than adequate to accommodate all the various and different items necessary to be stored. One reason for this is that the available storage area is often underutilized due to the nature of the items being stored and the structural confines of the particular storage area. As a result, others heretofore have concerned themselves with making more efficient use of available storage space and to leave less dead space in a storage area. This is particularly so where space is limited and at a premium in existing structures, e.g. in pantries, cupboards, kitchens, closets, refrigerators, etc. Thus, such concern has resulted in a variety of inventions.

One invention making better use of available space is the so-called closet organizer used in clothes closets. That invention divides up the closet space and makes use of every available inch thereof, for the storage of sweaters, shoes, etc., and the hanging of clothing. As a result much more clothing can be stored in a particular closet, and each item is more readily accessible.

There has also been invented various space saver devices for use in kitchen cabinets and in refrigerators whereby more dishes, food, or other items can be stored in the space available. This increased storage capacity, as with the clothes closet organizers, results from making better use of otherwise dead space.

Nevertheless, while many such space saver devices make better use of otherwise dead space in a storage area, the problem still remains that items stored in the back of kitchen cabinets and the like, such as canned goods, are not readily accessible. Neither, in some cases, can one even view such items sufficiently, to determine the identity of such, e.g. a can of peas, corn, etc. Moreover, in order to retrieve such an item stored on the shelf in the back of the storage area, it is often necessary to move aside the cans stored in front thereof. Sometimes, it is even necessary to remove the items stored in front momentarily from the storage area. Such may even necessitate moving the space saver device. Similar difficulties are encountered when replenishing the supply of canned goods on the shelf. To locate like items together, particularly where such items are at the back of a shelf, it often is necessary to move about and rearrange the cans.

Space for storage is not only at a premium in the home. Space considerations for storage and inventory of various and sundry items are also critical in commercial establishments. This is particularly so in such establishments which have limited wall space for cabinet installation, and in establishments where large numbers of individual items, particularly relatively small sized items, need be stored, sometimes close by for ready accessibility. Such requirements need be met in a number of different commercial establishments, e.g., in the prescription department of drug stores and in hospitals. Space requirements, and ready access to supplies and inventoried items, are also critical in the storing and inventory of spare parts or small supply items in various industries and commercial retail and wholesale establishments.

Exemplary of a space utilizing invention made heretofore is that disclosed in U.S. Pat. No. 3,089,745. In that patent, there is disclosed a cabinet with a plurality of vertically mounted shelving members each of which is provided with a plurality of horizontally disposed shelves superposed with respect to one another. The shelving members are each individually mounted to the cabinet walls whereby to be capable of being pivoted outwardly to the front opening in the cabinet. Thus, ready access is provided to the various items stored on the shelves.

Also, of interest, is the disclosure in U.S. Pat. No. 4,502,742. That patent discloses a storage unit which comprises a pair of vertically disposed bi-fold panels which are hinged at their respective inner vertical edges to opposite sides of the enclosure for the unit. The inner faces of each panel are provided with storage racks arranged in superimposed fashion. The panels in each pair can be disposed in a folded back to back relationship, when the doors to the unit are to be closed.

Nevertheless, while the space utilizing inventions disclosed in the above-mentioned patents are quite satisfactory for some uses, there remains a continuing need for space-saving storage units of different structural configurations for use in the home and various commercial establishments. In particular there remains a continuing need for space-saving storage units which provide even better utilization of potential storage space or dead space in a confined storage area in presently existing cabinets and for a variety of different sized items to be stored. Further, there exists the need for a suitable mounting system whereby such storage units can be mounted and installed in presently existing cabinets or in areas potentially available for storage.

In addition to concerns for the better utilization of space in the home and in commercial establishments and the providing of ready access to individually stored items as above-disclosed, there is also a need to provide better utilization of space and more ready access to, for servicing and/or replacement of, various electronic components mounted in a variety of products. Thus, for example, in television cabinets, main frame and other computers, radios, control room equipment such as found in manufacturing operations and the like, etc., the present stacking of electronic components, at least in some cases, prohibits there being provided a more compact structural unit or one in which ready access to a particular component is possible. Oftentimes, the servicing of such items is made more complicated as the particular electronic component needing replacement or servicing, or at least testing, is not readily accessible. Such a component may, for example, be mounted on a board which can be reached only after removing certain fastening means, or other boards mounted in front of the one of concern. Thus, there is also a need for a mounting system for support members for electronic components whereby there is provided more ready access to any particular component for exchange or servicing while at the same time providing compactness in structure through better utilization of space.

SUMMARY OF THE INVENTION

A primary object of the invention is to provide an easy access and space utilizing unit which comprises a plurality of individual storage compartments hingedly connected together and a mounting system therefor whereby the unit can be folded into a compact size so as to maximize the use of the storage space available in an internally defined storage area for the storing of individual items and of being unfolded to an extended position so that ready access is provided to those stored items.

A further object of the invention is to provide a vertically disposed storage unit comprising a plurality of individual vertically disposed storage compartments which are hingedly connected one to the other and a mounting system therefor whereby the storage unit is foldable into a compact unit and unfoldable to an extended position.

A still further object of the invention is to provide a storage unit which better utilizes available storage space through use of otherwise dead space.

A still further object of the invention is to provide a storage unit which can be installed in an existing cabinet for the storage of individual relatively small items whereby a larger number of such items can be stored in the same storage space than prior to such installation.

A still further object of the invention is to provide a storage cabinet including one or more storage units according to the invention.

A still further object of the invention is to provide a storage cabinet provided with a mounting system according to the invention.

Quite advantageously, a storage unit according to the invention can be mounted not only in an existing cabinet, it can also be mounted in any accommodating, vertically disposed recess along a wall, in a home or a commercial establishment.

Another advantage of a storage unit according to the invention is that it can be easily installed in a suitably sized storage area in an existing cabinet structure with a few conventional fasteners such as screws or bolts with minimum skill and tools.

A unique feature of the invention is that a storage unit is provided whereby every item stored in the storage space can be readily seen when the unit is in its extended position and each such item can be removed, if desired, without the necessity of moving and disturbing other items stored in the storage space.

A further unique feature of the invention is that visual and unobstructed reference can be made rapidly to any item stored in the storage area.

A still further unique feature of the invention is that a unit is provided for the mounting of a plurality of individual electronic components wherein ready access to any such components is made possible for replacement or servicing.

An even further unique feature of the invention is that it can be provided in kit form, as an assembly of components to be assembled together by the user or another installing the space saving storage unit in an existing storage area.

BRIEF DESCRIPTION OF THE DRAWINGS

The invention will be more clearly understood by reference to the drawing in conjunction with reading the following specification, in which:

FIG. 3 (*b*) is a plan view of the top lever of the mounting system shown in FIG. 3 (*a*) better showing the angular relationship of the end portions thereof in one embodiment of the invention relative to the elongated middle portion and the angular relationship to one of the middle portion to the other;

DETAILED DESCRIPTION OF THE INVENTION AND THE PREFERRED EMBODIMENTS

Figure 1:
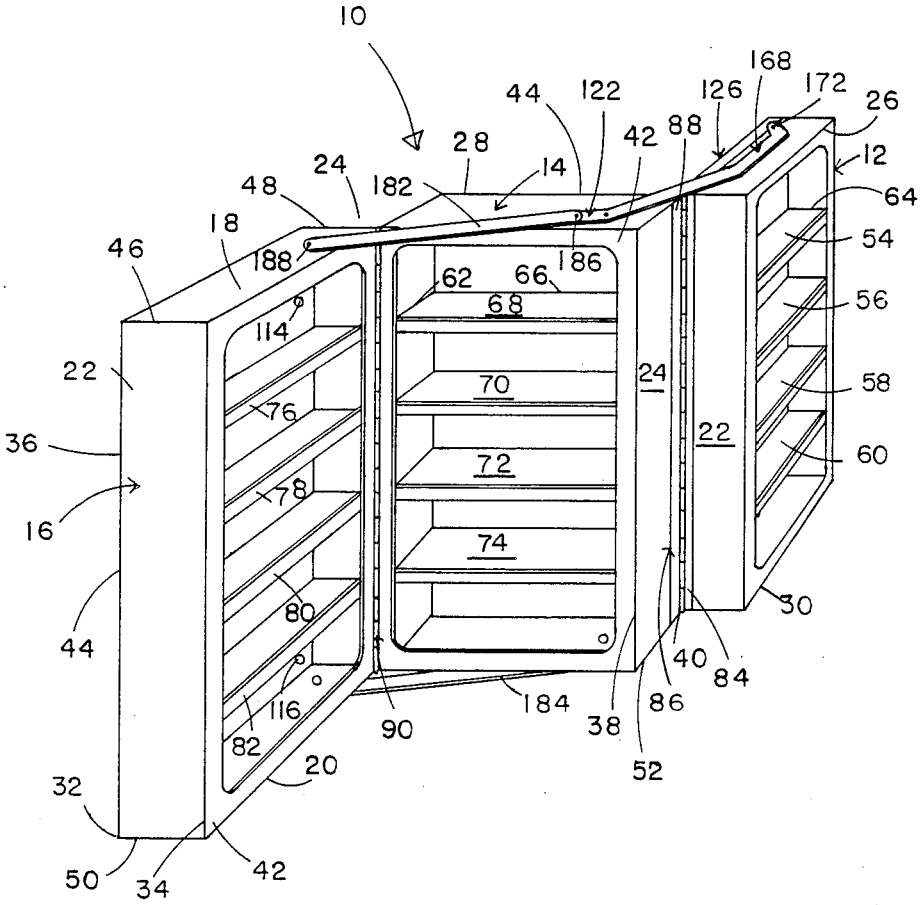
FIG. 1 is a view in perspective showing a storage unit according to the invention in which the individual storage compartments comprising the unit are shown hingedly connected together and are in position.

Referring now to FIG. 1 of the drawing there is shown therein a storage unit 10 comprising a plurality of vertically disposed, individual storage compartments 12, 14, and 16. The said storage compartments are of identical, rectangular-shaped, box-like configuration, each of which, as will be seen by reference to storage compartment 16, is defined by planar horizontally disposed first and second end panels or members 18, 20, defining the top and bottom of the compartment, and which are parallel to one another and connected at their ends to respective ends of parallel, planar first and second side panels or upright members 22, 24. The top and bottom end panels 18, 20 and side panels 22, 24 are defined by linear, front and back edges 26, 28, and 30, 32, and 34, 36, and 38, 40, respectively. As seen from the drawings, the front and back edges of the top and bottom panels, and those of the side panels, are parallel to one another.

Preferably there is attached to each of the storage compartments, at the said front edges 26, 30, 34, 38 a front member 42. As will be readily appreciated, front member 42 provides an inwardly disposed flange, perpendicular to the said front edges which defines the front opening and acts to provide greater structural strength and rigidity to the storage compartment. Each of the storage compartments is closed on the back side by a planar vertically disposed back member 44 connected to the back edges 28, 32, 36, 40 of the top and bottom members 18, 20, and side members 22, 24.

The top and bottom members 18, 20 can be connected at their ends 46, 48, and 50, 52 to the ends of respective side members 22, 24, and to back member 44 at their back edges according to any conventional technique, e.g. by screw fasteners, nails, adhesive, etc., depending somewhat on the material of construction used for the storage unit, and the particular cabinet application in which the storage unit may be located, as hereinafter more fully disclosed.

Located within each storage compartment, as seen by reference to FIG. 1, are a plurality of horizontally disposed shelves 54, 56, 58, and 60. These shelves are provided in uniformly spaced-apart, parallel, superposed fashion, one above the other. It will be appreciated, however, that fewer than four shelves as shown can be provided, if desired, depending on the height of the items to be placed in the storage compartment. Or, if desired a greater number of shelves can be provided. Although the shelves, as shown by the drawing, are uniformly spaced-apart, the distance between next adjacent shelves need not be the same, in any particular storage compartment. Moreover, if desired, the shelves in the different storage compartments can be uniformly spaced-apart, but at different distances from one another. Or if desired, the shelves in one such compartment can be uniformly spaced-apart and in the others spaced-apart in non-uniform manner.

Shelf 54, as can shelves 56–60, can be fixedly secured at its ends 62, 64 to the inside surfaces of the upright side members 22, 24, and, if desired, along their back edges 66 to the inside surface of back member 44. This can be accomplished by any of various conventional fastening means. Depending upon the particular material of construction of the storage compartments, the shelves may be provided integral with the side panels and back member of the unit, e.g., where the storage compartment is molded from a suitable plastic composition. The shelves 54–60, however, can be provided in adjustable relationship in the storage cavity in each storage compartment, if desired. This can be readily accomplished by use of conventional shelf hanging hardware using various well-known techniques. For example, support members (not shown) which extend outwardly from the side members 22, 24 in opposition to one another and which are connected to the side members in some suitable fashion can be used. Thus, such support members can each comprise a horizontally disposed member long enough to provide support to a horizontally disposed shelf member at each end thereof on its underneath side. Such members, if desired, can each be provided with projecting means in opposition to the said horizontally disposed support member, as is commonly done, which projects into an opening or dead bore (not shown) provided in the side members. In such a case, each of the vertically upright side members can be provided with a plurality of superposed, horizontally disposed, rows of openings (not shown) for such support members, making the shelf members readily adjustable to the height of the items being stored in the storage compartment. Each horizontal row should contain at least two openings whereby support members (not shown) can be provided adjacent the front and back edges of a shelf-member, and such can be provided in a level, horizontally stable orientation.

As will be seen in FIG. 1, shelves 54–60 each comprises a horizontally disposed planar shelf member 68, 70, 72, 74. The shelf members are each provided at their respective front edges with vertically upright members 76, 78, 80, 82 which serve to confine or retain any items stored on the respective shelves to that shelf. Thus, any item stored on the shelf is prevented from falling off, during the folding or unfolding of the storage unit as described hereinafter. Such a retaining member need not be provided, as shown in the drawing, integral with or connected to the front edge of the horizontally disposed planar shelf members. Instead, such a retaining member can be, for example, a slat-like member (not shown) extending horizontally across the opening of the storage compartment, the ends of which are connected in some suitable conventional manner to respective side members 22, 24. Such a retaining member can be located at some suitable distance above the horizontally disposed shelf member, depending somewhat upon the height of the items to be located on the shelf. It will be appreciated that, in some cases, the upright retaining member will need be wider than at other times, or more than one such a retaining member may be desirable for items that are somewhat tall. The ends of such restraining members need not be permanently secured to the side panels. If desired, such slat-like retaining members (not shown) can be provided at their ends with a downwardly extending flange (not shown), the purpose for which will soon be made obvious The side panels, in such a case, will each be provided with a plurality of vertically disposed openings (not shown) and in opposition to one another, to accommodate the ends of the horizontally-disposed retaining member. The downwardly extending flanges at each end will serve to prevent the retaining member from accidentally coming out of the said openings therefor.

Storage compartments 12, 14, 16, can be manufactured of various materials of construction, e.g., wood, metal, plastic, or wire or plastic lattice such as is conventionally now used in some storage racks and compartments e.g., in refrigerators and the space saver racks for kitchen cabinets. The particular material of construction chosen is of no particular consequence to the main concept of the invention disclosed herein and will depend somewhat upon the particular application for the storage unit. For example, storage compartments for storing inventory of autoparts may be fabricated of plywood or even peg-board, while such a unit used in a kitchen cabinet may be of higher grade wood, or of particle board or the like to which is laminated a decorative layer according to conventional techniques. The storage unit 10 might be fabricated of conventional metal lamina which has been provided with a painted or other decorative surface where such is being used to store pharmaceuticals or the like products in a hospital or drug store environment.

In some cases, it may be desired to provide the side and end members of a storage compartment of one material, e.g., wood, and the back member 44 thereof, of a different material, e.g., peg-board. Thus, the peg-board can be provided with various conventional hanging hardware Such a storage compartment would find particular utility in hanging various items, e.g., cups, if the storage unit is used in a kitchen cabinet, or tools, if used in a cabinet found in the home handyman's shop. Instead of providing shelfs such as shown in the drawing, in the storage compartments, wire or plastic storage racks or baskets will be found quite useful instead for storage of certain items. These racks can be provided with protruding members or hooks at their backside for intrusion into the peg-board, according to usual techniques. Or, if the back member is other than peg-board, other conventional hanging hardware can be used. Such a construction lends great versatility to the use of the storage racks. With a particular storage unit, one storage compartment could be provided with fixed shelving, another with a peg-board back member and appropriate hanging hardware, and a third storage compartment with adjustable wire racks.

As will be readily appreciated by those in the plastic molding art, a storage compartment 12 in accordance with the invention can be provided, if desired, of various plastic compositions, according to well known techniques. Compositions of polyethylene, polypropylene, polyvinyl chloride, nylon, acrylonitute-butadiene-styrene (ABS), to name some, can be used. The particular plastic composition used will depend somewhat upon the use to which the storage unit is to be put, and upon the size thereof. These compositions can be provided with various coloring agents to provide storage compartments of any color desired. Or the storage compartments can be manufactured of a clear composition, providing see through visibility to the items stored. Also, such compositions can include various additives commonly used. For example, these compositions can include various conventional fillers to alter the physical properties thereof, e.g., to provide better strength characteristics, greater impact resistance, more or less flexibility as desired, or fillers to lessen the cost, etc. With such compositions, the shelves 54–60, if desired, can be provided integral with the storage compartment in the molding operation.

As will be seen by reference to FIG. 1, the storage compartments 12, 14, 16 are connected one to the other so as to be foldable into the most compact size and unfoldable to an extended position. This is accomplished by hingedly connecting storage compartment 12 to storage compartment 14 so that the two compartments can be folded back to back and hingedly connecting storage compartment 14 to storage compartment 16 so that these two compartments can be folded in face-to-face relationship. Thus, leaf 84 of elongated hinge 86 (commonly referred to as a "piano" hinge) is connected to side panel 22 of storage compartment 12 along the marginal portion at the linear back edge 36 thereof, and leaf 88 is connected to storage compartment 14 at the back edge 40 of side panel 24. And, one leaf (not shown) of elongated hinge 90 is connected to side panel 22 of storage compartment 14 along the margin of the front edge 34, and the other leaf (not shown) of hinge 90 is connected to the front edge 38 of side panel 24 of storage compartment 16. This can be accomplished by use of any conventional fastening means, e.g. screw fasteners.

Although only three storage compartments are shown in FIG. 1 to be connected together in foldable relationship, it will be appreciated that in some cases, a greater number of storage compartments may be so connected. The main requirements in any such case is that the compartments be hinged together in such fashion as to provide a compact unit such as disclosed herein when the compartments are folded one against the other. Nevertheless, the preferred number of compartments in a storage unit according to the invention is no more than three, e.g., in a unit installed in a kitchen cabinet used for the storage of relatively heavy canned goods. The optimum number of compartments comprising a storage unit will depend to some extent, however, on the size of the available storage area, the desired size of the individual compartments, and on the particular items to be stored, in particular their individual weight and the total weight of all items being stored at any one time, among other considerations. It will be readily appreciated, as later more fully disclosed, that the greater the total weight of items being stored, the greater the torsional stress placed upon the mounting system.

A storage unit 10 according to the invention can be installed in the enclosed storage area of an existing cabinet, e.g., a kitchen cabinet, if desired, in which case all the supporting structure for such a unit is already provided, as will be disclosed more fully hereinafter. Or the storage unit 10 can be installed, in some cases at least, in an already existing recess in a wall. In general, the main consideration in installing such a storage unit in an existing recess is that certain supporting structure will need, at least, be provided, e.g., top and bottom, horizontally disposed members will need be provided, to define an internal storage space having a front opening, and, importantly, to provide support means for attachment of the mounting system, later more fully disclosed, for the storage unit. Or, as will be appreciated, a storage unit of the invention can be provided instead in newly fabricated cabinet structures to be used for storage purposes.

Figure 2:
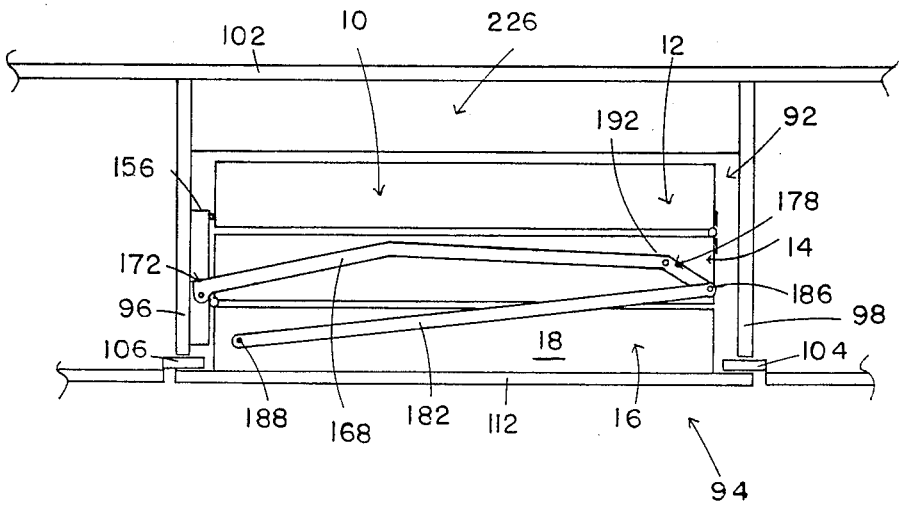
FIG. 2 is a top plan view of the storage unit shown in FIG. 1 folded into its compact size and installed in the storage area provided within an existing enclosure such as a kitchen cabinet.
Figure 4:
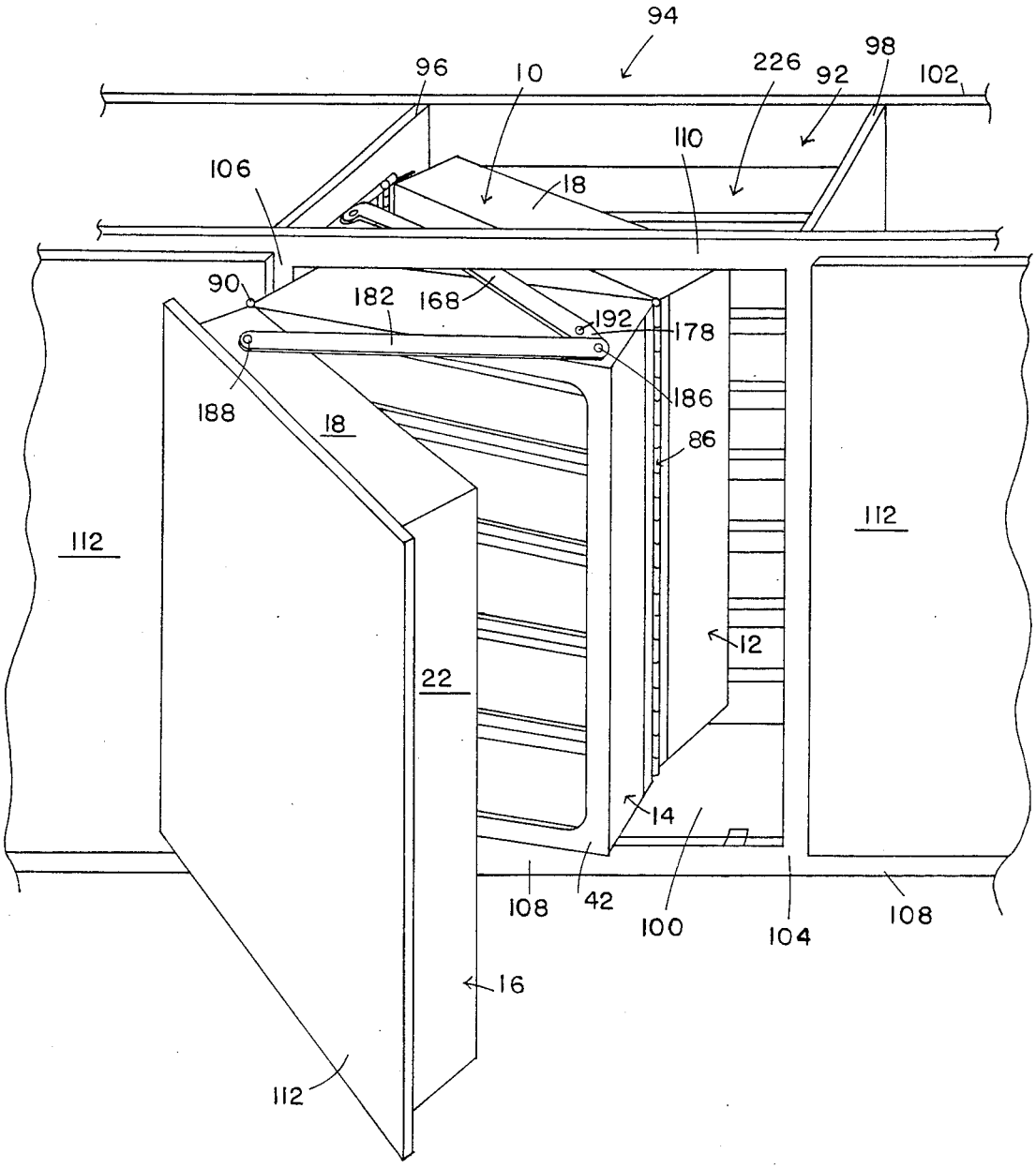
FIG. 4 is a perspective view of a storage unit of the invention as shown in FIG. 1 installed within the storage area of a cabinet as shown in FIG. 2, showing the storage unit as it is being unfolded to the extended position.

Turning now to FIG. 2 of the drawing, storage unit 10 is shown in its compact, folded position, as installed in the internally defined storage area 92 of the kitchen cabinets, shown in part in that figure, and referred to generally by reference numeral 94. These cabinets comprise, as is conventional, a plurality of individual internal storage areas defined, in general, by vertically disposed upright dividing, or wall, members 96, 98 and base member 100 (See FIG. 4). Only one such storage area is shown in the FIGS. 2 and 4, however, for sake of clarity in describing the invention. Where cabinets are built during the construction of the kitchen, initially, it is often the case that the ceiling takes the place of any top member for the cabinet and that the wall to which the cabinets are attached serves to close off the back. Nevertheless, where preconstructed cabinets are installed in the kitchen, such cabinets may have a back member such as shown generally by reference numeral 102, and a planar top member can be provided, if desired. As shown in FIG. 4, the cabinet 94 further comprises conventional vertically disposed face members 104, 106, disposed perpendicular to and attached to and facing upright members 96, 98, and horizontally disposed face members 108, 110 providing a facing for base member 100 and with the vertically disposed face members 104, 106, defining the front opening for the storage area. These face members, e.g. face member 106, in the case of a right-side opening door, conventionally provide a means for hingedly supporting the cabinet door 112 which, in the practice of the invention is, instead, affixed to the back member 44 and supported by storage compartment 16. The cabinet door 112 is slightly larger, as is usual, than the front opening for the storage area or space 92 and the face members 104, 106, 108, and 110 provide a stop therefor, when storage unit 10 is folded into its most compact size, as shown in FIG. 2. The face members are connected to the vertical upright wall members 96, 98, according to usual techniques, e.g., by nails. Although not shown in the drawing, a horizontally disposed member will generally be provided, as is conventional, which is connected both to horizontally disposed member 110 at spaced locations along its length, on the inside surface thereof, and to the ceiling, since no top member is usually provided for the storage area. Also, horizontally disposed members (not shown) may also be provided disposed in perpendicular fashion with the wall on which the cabinet is located and alongside the upper end of the upright dividing members 96, 98. Such horizontally disposed members may be, in some cases, provided on each side of the dividing member and are connected, e.g., by nailing to the ceiling, and if only one such member is used, to the adjacent dividing member. Such a last-mentioned horizontally disposed member will provide a means for fastening the upper part of the mounting system for the storage unit, as hereinafter more fully disclosed. It will be appreciated, however, that the construction of kitchen and other cabinets is well known. Accordingly, it is not believed that such construction need be further described at length in this specification, as such does not affect the concept of the invention disclosed herein.

The installation of storage unit 10 in an existing kitchen cabinet, as will be readily appreciated, requires that first the shelves all be removed. The cabinet door 112 will also be removed, as will the hinges therefor (not shown); however, the door 112 is attached to the back member 44 of storage compartment 16 whereby to provide a closure for the storage area front opening. This can best be accomplished subsequent to installing the storage unit 10 in the storage area and by using conventional screw fastening means (not shown). Thus, door 112 can be connected to storage compartment 16 through openings 114, 116 (FIG. 1) provided in the back member 44 of storage compartment 16. Although only two such openings are seen in FIG. 1 of the drawings, it will be appreciated that two other such openings will be provided in back member 44, adjacent side panel 22, whereby two other screw fasteners can be inserted and screwed into cabinet door 112 to secure that door to storage compartment 16. The door will be so located with respect to back member 44 as to provide a border around the compartment and to provide that the door fits uniformly and evenly over the opening according to usual technique.

Figure 3:
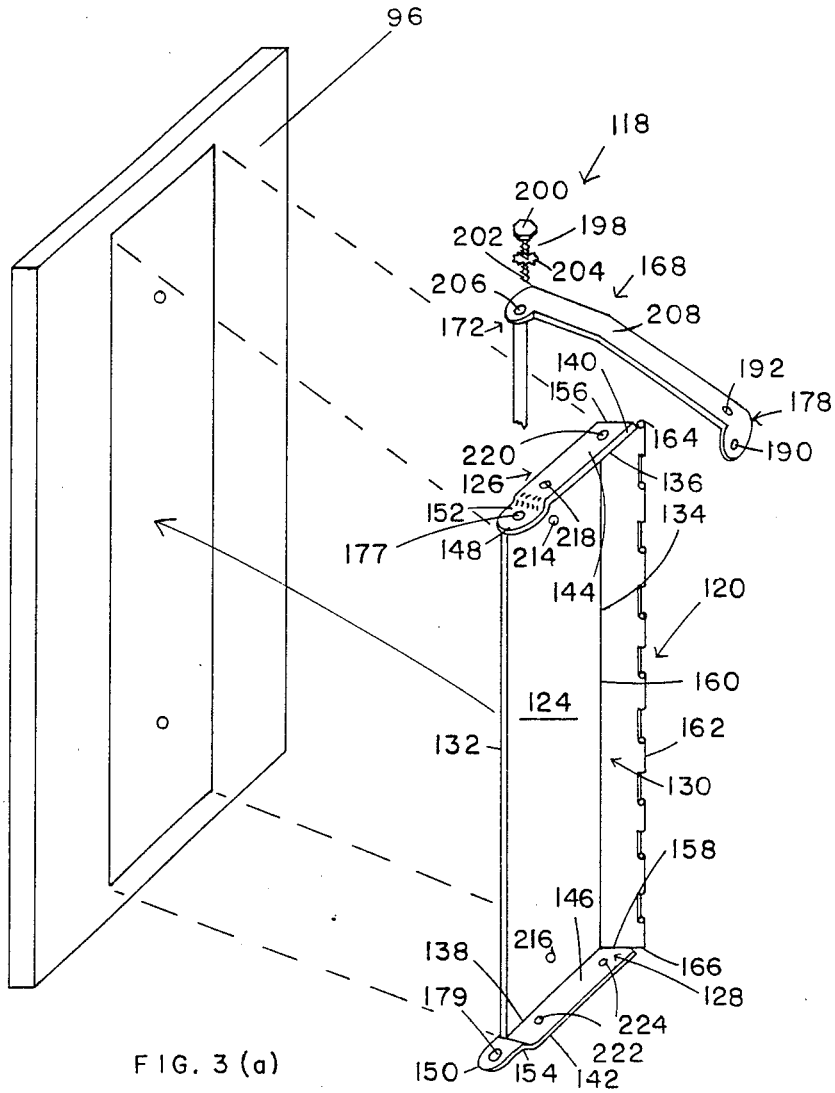
FIG. 3 (*a*) is an exploded perspective view of a portion of the mounting system according to the invention for supporting the storage unit of FIG. 1 in the enclosed storage area as shown in FIG. 2.
Figure 3B:
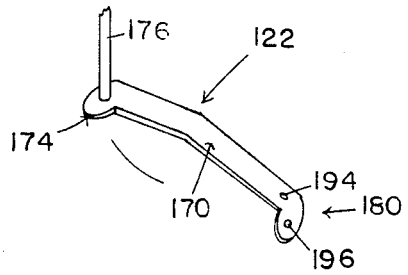
Figure 3B:
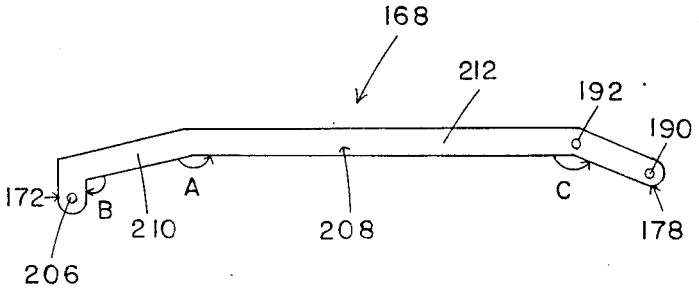

The installation of storage unit 10 in the storage area 92 whereby it can be folded and unfolded as desired, is accomplished by use of mounting system 118 (FIG. 3(*a*), (*b*)) which comprises in combination the mounting assembly 120 and linkage system 122. Mounting assembly 120, as seen more clearly by reference to FIG. 3 (*a*) comprises, in combination, mounting plate 124, first and second mounting flanges 126, 128, and one leaf 130 of an elongated hinge. Mounting plate 124 is of planar configuration and is defined by elongated front and back edges 132, 134, parallel to one another, and parallel, first and second side edges 136, 138. At the respective side edges 136, 138 of mounting plate 124 are connected mounting flanges 126, 128. These mounting flanges, as shown, extend perpendicularly outwardly from mounting plate 124 at the side edges and are defined by outer linear edges 140, 142, which edges are in the sam plane and parallel to that plane defined by mounting plate 124. The mounting flanges, as seen from the drawing, in the preferred aspect of the invention, comprise planar main portions 144, 146 and end portions 148, 150, the said main and end portions being located in outer and inner planes, respectively, parallel to one another. The main portions are connected to and made integral with the end portions in the respective flanges by vertically disposed connecting portions 152, 154. The end portions at the ends opposite to the respective connecting portions are seen to be rounded, which is preferred. The mounting flanges 126, 128 are defined at their other ends by back edges 156, 158.

The mounting assembly 120 further comprises, as earlier disclosed, one leaf 130 of an elongated hinge. This leaf is defined by an elongated linear edge 160 and an elongated hinge edge 162 parallel thereto and first and second end edges 164, 166 permanently connected to respective mounting flanges at the back edges thereof. Leaf 130 extends perpendicularly outwardly from mounting plate 124 and linear edge 160 is permanently connected to mounting plate 124 at its elongated back edge 134. These members, can be connected together by various known techniques, e.g., by welding or brazing. Nevertheless, it will be appreciated that mounting assembly 120 can be, if desired, stamped out of a single piece of metal and provided as an integral unit.

The mounting assembly 120 will generally be fabricated of metal components; however, in some cases, such assembly can be manufactured from suitable plastic compositions by conventional molding techniques. Any plastic material can be used provided such material has suitable strength characteristics. This, of course, will depend somewhat upon the particular application for the storage unit, and the size of the storage unit involved. The heavier the items to be stored in the storage compartments, the greater the structural strength characteristics need be. Where the mounting assembly is molded from a plastic composition, the flanges and hinge can be provided integral with mounting plate 124. Exemplary of the plastic compositions that will be found suitable, in some applications, is Delrin polyacetal resin. Nevertheless, any plastic composition conventionally used in structural applications will be found suitable provided such can withstand the repeated strain placed thereon in the folding and unfolding of the storage unit and has the strength and rigidity to hold the weight of the unit, particularly in the extended position.

As shown in the drawing, the mounting plate 124 is of rectangular configuration; however, it need not be. This depends upon the vertical dimensions of the storage area involved and the height of the storage compartments 12, 14, and 16. In general, the storage area in kitchen cabinets are of rectangular-cubic configuration, rather than being of square configuration. If desired, a spacer member (not shown) can be provided in combination with the mounting assembly. Such a member will be coextensive with mounting plate 124 and fit within the confines of, and take the shape of, the space defined by leaf spring 130, edge 132 of mounting plate 124 and the mounting flanges 126, 128. The inner face of such a member will be in contact with and located directly against the outside planar surface of mounting plate 124. The outer planar face of such a spacing member will terminate and be in a plane defined by the linear edges 136, 138 of the mounting flanges. The spacing member can be secured to the mounting plate by any conventional fastening means. Although such a spacer member is not required in the general concept of the invention, such a member will, in some cases, lend support to the mounting assembly and prevent distortion and misalignment of the leaf 130 and mounting flanges 126, 128, particularly where relatively heavy items are being stored in the storage compartments.

Whether or not a spacer member is used in the practice of the invention, it will be appreciated by reference to FIG. 2 that a free space is provided between the upright dividing members 96, 98 and the storage unit 10 at each side thereof. This space should be essentially the same on both sides whereby to center the storage unit 10 and to allow the storage unit to be pulled outwardly and to be fully extended without interference from the upright members. In general, such spacing from the upright members should be about $\frac{3}{4}''-\frac{1}{4}''$; however, the free space needed depends somewhat upon the depth of the storage area, the number of storage compartments in the storage unit, and the depth of each.

The mounting flanges are preferably of the structure shown, i.e., the end portions 148, 150 are preferably located in parallel planes located inwardly from the planes defined by the main portions 144, 146, the reason for which will become more obvious later on. Nevertheless, in some cases this may not be absolutely necessary for proper operation.

In operative association with the mounting system 120 there is provided linkage system 122, the functioning of which will soon be more fully disclosed. Linkage system 122 comprises a pair of first elongated levers 168, 170 operatively connected at inner pivotal ends 172, 174 to the ends of an elongated rod or shaft designated by reference numeral 176 and at their respective outer pivotal ends, 178, 180, described more fully hereinafter, to respective second elongated levers 182, 184 (FIG. 1). The ends of elongated shaft 176, as seen by reference to FIG. 3 (*a*) extend through circular-shaped openings 177, 179 located centrally in respective end portions 148, 150 of the mounting flanges 126, 128.

The ends of elongated lever 182 are provided with circular shaped openings 186, 188, as will be appreciated from the drawings, particular reference being made to FIGS. 2, 4. Although not shown in the drawings, it will also be appreciated that similar such openings are provided in elongated lever 184. Elongated lever 182 is pivotally connected at its one end 186 to the elongated lever 168 at the outer end portion 178 thereof, and at the outer opening 190 provided therein. This can be accomplished in accordance with various conventional techniques. One example is to provide a cylindrical-shaped member, threaded at both ends, which extends through the openings 186, 190 in the lever ends, and which is then provided with appropriate complementary threaded members for maintaining the cylindrical-shaped member in the openings. Or, as is sometimes conventionally done, this connecting member can be a double-headed rivet or the like. The main thing is that lever 182, be allowed to pivot with respect to the end portion 178 of lever 168 and in a plane parallel thereto. The other end of the elongated lever 182 is pivotally connected in similar fashion by a cylindrical-shaped member extending through circular-shaped opening 188 and a similar such opening in the end panel 18 of storage compartment 16. Thus, lever 182 will be able to pivot at one end relative to storage compartment 16 and at the other end relative to storage compartment 14. The pivotal member need not extend through an opening in the end panel 18 of storage compartment 16, however. Instead, such a member can comprise a vertically upright cylindrical-shaped member having a head at its top end and being threaded at the other end and extending downwardly through opening 188 and being threaded into an opening provided in a horizontally disposed member attached to end panel 18.

Referring to FIGS. 2 and 3(*b*), it will be seen that the outer end portion 178 of elongated lever 168 is pivotally connected in similar fashion to the end panel 18 of storage compartment 14 at the inner opening 192 provided in that end portion. In similar fashion, and in locations in opposition to the lever 182, elongated lever 184 is pivotally connected to storage compartment 16, at the opposite end 20, and the end of elongated lever 170, and the outer end of lever 170 is pivotally connected to storage compartment 14. Circular-shaped opening 194, 196 are provided in the outer end portion of lever 170 (FIG. 3(*a*)) for providing similar pivotal connection to lever 184 and the storage compartment 14.

The inner end portions 172, 174, respectively, of levers 168, 170 are fixedly connected to the ends of elongated rod 176, and in such a manner as to be in opposition to one another. Thus, when lever 168 is caused to move, lever 170 will move in unison therewith. And when storage unit 10 is installed and properly mounted in the storage area 92 of cabinet 94 or the like, by pulling or pushing on door 112 attached to storage compartment 16 (FIG. 4) the storage unit 10 will be caused to extend into the unfolded position, as shown in FIG. 1, or to fold into the compact, folded mode shown in FIG. 2.

The inner ends 172, 174 can be secured to the ends of rod 176 in any conventional manner so long as the levers 168, 170 and rod 176 move in unison with one another and lever 168 moves in unison with lever 170. Thus, where the levers and rod are of metal, the ends of the levers can be welded to the respective ends of rod 176, in which case the ends of the rod may be located in circular-shaped openings located in the inner end portions 172, 174. Or, if desired, the ends of the rod can be provided with a thread pattern, next adjacent to which is provided an irregular periphery, e.g. hexagonal. In such a case, hexagonal-shaped openings can be provided in the end portions 172, 174 for mating with the hexagonal flats provided on the rod 176 and the levers 168, 170 secured thereto by complimentary threaded members, e.g. nuts. In come cases, the lever 170 can be fixedly connected to rod 176 while the end portion 172 of lever 168 is detachably connected to the end of rod 176 by connecting means 198, as is shown in FIG. 3 (*a*), which comprises a threaded member having a head 200 and a threaded shaft 202 surrounded by a lock washer 204. The threaded shaft 202 extends through an opening 206 provided in the inner end portion 172 of lever 168 and is received in a threaded dead bore (not shown) provided in the end of the elongated rod 176. Thus, lever 168 is securely connected to the elongated rod and is caused to move in unison therewith without slippage.

The elongated member or shaft 176 need not necessarily be a solid rod. It can, in some cases, be a tubular member. Neither need the elongated shaft 176 be round in cross-section along its entire length It can be of irregular shape, if desired, except at the ends thereof in which case the ends will be of circular-shape and extend through the openings 177, 179 provided in end portions 148, 150 of the mounting flanges 126, 128 and be fixedly connected to and with the levers 168, 170. The main consideration is that the shaft 176 be of such materials and size/shape as to be able to withstand the repeated torsional stress to which it is subjected. Its dimensions should, however, be such as to present no problems in rotation relative to the mounting plate 124.

It will be appreciated that the circular-shaped openings 177, 179 are bearing surfaces relative to the elongated shaft 176 which rotates therein. Thus, it may be desirable to provide an annulus of low friction material in said openings through which the ends of shaft 176 will extend. This is conventionally done for rotating shafts, and can be accomplished according to usual techniques. Such will provide easier and better rotation of shaft 176 relative to the mounting system, in the use and operation of the storage unit 10 and result in less wear in either the openings 177, 179, or on the ends of the elongated shaft. As a result, the desired vertical disposition and alignment of shaft 176 will be better maintained. Rather than providing merely an annulus of low friction material, e.g. of Delrin polyacetal resin, nylon, or Teflon polytetrafluorethylene resin, those skilled in the art will appreciate that other even more suitable bearing members according to known techniques may be used which allow good rotation of an elongated shaft member. Also, it will be appreciated that similar bearing members or low frictional characteristic annular members can be provided in the openings in the ends of the levers 168, 170, and 182, 184, to provide better rotational or pivotal characteristics.

The elongated levers 168, 170 are of identical construction, only one of which will be particularly described, reference being made to FIG. 3 (*b*). As shown in that figure of the drawing, elongated lever 168 is of planar configuration and comprises an elongated middle portion 208 from the ends of which protrude the pivotal end portions 172 and 178. The middle portion 208 as shown, comprises two parts, namely a first elongated inner portion 210 and a second elongated outer portion 212 which join together at an angle A. As shown in FIG. 3 (*b*), inner and outer pivotal ends 172 and 178 are at angles B, C, respectively, relative to the first and second elongated portions 210, 212. The angles A, B, and C will depend upon a number of considerations, depending somewhat upon the particular use for the storage compartments 12, 14, and 16, and the weight of the items to be supported by and stored in the storage compartments. Thus, in some cases, e.g., where the items to be stored are of relatively light weight, and the size of the compartments are relatively small, the angles, A, B, and C may each be 180 degrees whereby lever 168 is straight or of linear configuration, the same as are levers 182, 184. Nevertheless, where the items stored are of a relatively heavy weight such as canned goods stored in a kitchen cabinet, or the storage compartments are of a relatively large size such as found in such cabinets, or both, it may be desirable, and, in fact, is preferred, to provide that end portion 172 is at a slightly obtuse angle with respect to the inner portion 210 of the lever 168. Thus, a greater torsional effect will be the result when the storage unit 10 is caused to be unfolded, and to be folded into its compact size. This will provide some counterbalance to the weight of the storage unit 10 and the weight of the items being stored. An even greater effect can be provided where angles A and C, as well as angle B, are less than 180 degrees. Nevertheless, satisfactory results will be provided in some cases where angle C is 180 degrees and angles A, B are obtuse angles, i.e. an angle greater than 90 degrees, but not necessarily the same. In general, however, the greater the size of the storage unit involved and the weight of the items being stored, the greater should be the angles A, B, C, to provide the best operating results. The optimum angles desired will depend, however, to some extent upon the overall length of the elongated levers 168, 170, the size of the storage compartments, particularly the width thereof and the particular location of the pivotal point 192 with respect to storage compartment 14.

In the practice of the invention, the storage unit 10 comprised three individual compartments 12, 14, 16, each measuring approximately 24" (height)×14 37/64" (width)×2⅞" (depth) and being connected together by hinges as shown in FIG. 1, whereby to be folded into a compact size and unfolded in extended length as disclosed. This unit was installed in the storage area of a conventional kitchen cabinet measuring 30"×18"×12" using a mounting system such as disclosed in FIGS. 3(*a*), (*b*). The mounting plate 124 was of rectangular shape measuring about 26"×7⅞" and was provided with mounting flanges about 7⅞" long and which extended approximately ¾" perpendicularly outwardly from the mounting plate. Screw fasteners were screwed into the upright member 96 defining the storage area, through openings 214, 216 in the mounting plate 124, whereby to secure the mounting plate to the vertically disposed support member. Likewise, screw fasteners were screwed into the base member 100 of the storage space 92 and into a horizontally disposed member extending perpendicularly outwardly from the wall through openings 218, 220, and 222, 224 provided in respective flange members 126, 128. Thus, the storage unit 10 was securely installed and mounted within the storage space available. It will be appreciated that the storage unit was mounted on upright support member 96 so as to be centered with respect to the vertically disposed opening of the storage space whereby there is no interference with the lever system by either the top or bottom members defining the front opening of the storage space. In the rear of the storage compartment was provided a fixed shelf unit denoted generally by reference numeral 226 (FIGS. 2 and 4) which can be provided with either a plurality of fixed or adjustable horizontally disposed shelves according to conventional techniques.

The unfolding and folding of the storage compartments, in practice, was accomplished by levers 168, 170, each having a length of about 13 19/64" from opening 206 to opening 192 and of about 4¼" from opening 192 to opening 190, and a width of about ¾". The outer end portions 178, 180 of the levers 168, 170 were provided at an angle C=124 degrees with respect to the middle portion, e.g. the middle portion 212. The angle A was 168 degrees. The inner end portions 1 72, 174 each connected with respective middle portion, e.g. middle portion 210, at an angle of B=102 degrees. It will be appreciated that inner end portions 172, 174 and flange ends 148, 150 of the respective levers and flanges are essentially coextensive in their shape and dimensions. Nevertheless, the inner edge of the levers 168, 170 must be spaced sufficiently far enough from the upright connecting members 152, 154 so that such members do not interfere with the proper rotation of these levers. Such edges, if desired, can be rounded where connecting with the respective inner end portions. And, connecting members 152, 154 can be of complementary arcurate shape. Furthermore, it will be appreciated that the inner surfaces of the end portions 172, 174 need be sufficiently spaced from the upper adjacent surfaces of flange ends 148, 150 as to be out of contact with one another and so that no interference will be caused to the proper rotation of the levers 168, 172.

The elongated levers 182 and 184, as were levers 168, 170, were manufactured from conventional steel plate having a thickness of ⅛". Nevertheless, it will be appreciated that such dimension will depend upon, among other things, the dimensions of the compartment, the weight being supported, and the materials of construction. These levers measured about 12½" (opening 186 to opening 188)×¾". The end 188 of the elongated lever 182 was connected to storage compartment 16 at a point about 1½" inwardly from back member 44 and about 1" inwardly from side panel 24, and at the end 186 to the outer end portion of lever 168. The outer end portion 178 of the lever 168 was pivotally connected to storage compartment 14, and end panel 18 at a point about 1½" inwardly from the front edge 26 and about 1¼" from the side member 24. Thus, when the levers are so connected, the storage unit 10 can be folded into a compact unit as seen in FIG. 2 and when unfolded the storage compartments will be provided at approximately ninety degree angles one to the other by pulling outwardly on door 112. Other length levers can be used, however, and the ends of the levers can be connected to the storage compartments at different locations whereby to allow different orientation, e.g. angles greater or less than 90 degrees, of the storage compartments one to the other in the extended mode. The particular configuration, size and shape of the levers 168, 170 will, as above disclosed, depend upon a number of factors. In any consideration thereof, however, the main factor is that the levers be of such a size, shape and configuration as to enable the storage compartments to move in a coordinated traverse, and to clear the cabinet structure defining the storage space without interference.

With a storage unit 10 according to the invention, it will be found that, when used to store conventional canned goods in a kitchen, a considerably greater number of such items can be stored than in the typical such storage space provided with conventional shelving. Moreover, each such can or item stored is visible, when the unit is in the extended mode and can be removed from its storage compartment without disturbing any of the other canned goods or items stored therein, and in the available storage space.

It will be appreciated that the storage unit 10 of the invention will find many applications. It can be made, according to conventional techniques, so as to be pressure tight, such as in the case of a refrigerator unit Or it can be manufactured entirely of a wire lattice. The particular application will determine the material of construction to be used in the manufacture of a storage unit according to the invention.

The installation and location of the mounting plate will be determined, in part, by the depth of the available storage space and the relative depth of the storage compartments. The location of the back edge 156 of the mounting assembly 120 must be spaced apart from the existing wall at least the depth of the storage compartment 12. Nevertheless, in some cases, as disclosed herein, it may be desirable to have a fixed shelf unit attached directly to the kitchen wall or back wall of the available storage area, and not a part of the storage unit of the invention. In such a case, the location of the back edge of the mounting plate 124 will be determined by the front of such a fixed storage compartment and the depth of storage compartment 12, not the back wall to which such fixed compartment is attached. Also, though the invention has been particularly disclosed with a cabinet door closing against a stop, it will be appreciated that such need not be the case. The original replaced door could also be of flush or recess design relative to the original cabinet. The compartment corners could also be rounded, if desired.

The end portions 148, 150 of the mounting flanges 126, 128 need not be in parallel planes located inwardly of the planes defining the main portions 144, 146. Instead, they can, if desired, be in the same plane as the main portion. The mounting flanges, in such case, may need be spaced apart at their main portions from the support members to which the mounting system is attached by a spacing member to provide satisfactory operation. Such a spacing member will need be at least the thickness of lever 168 (and 170 at the other end) so that the levers will be rotatable without interference.

Figure 5:
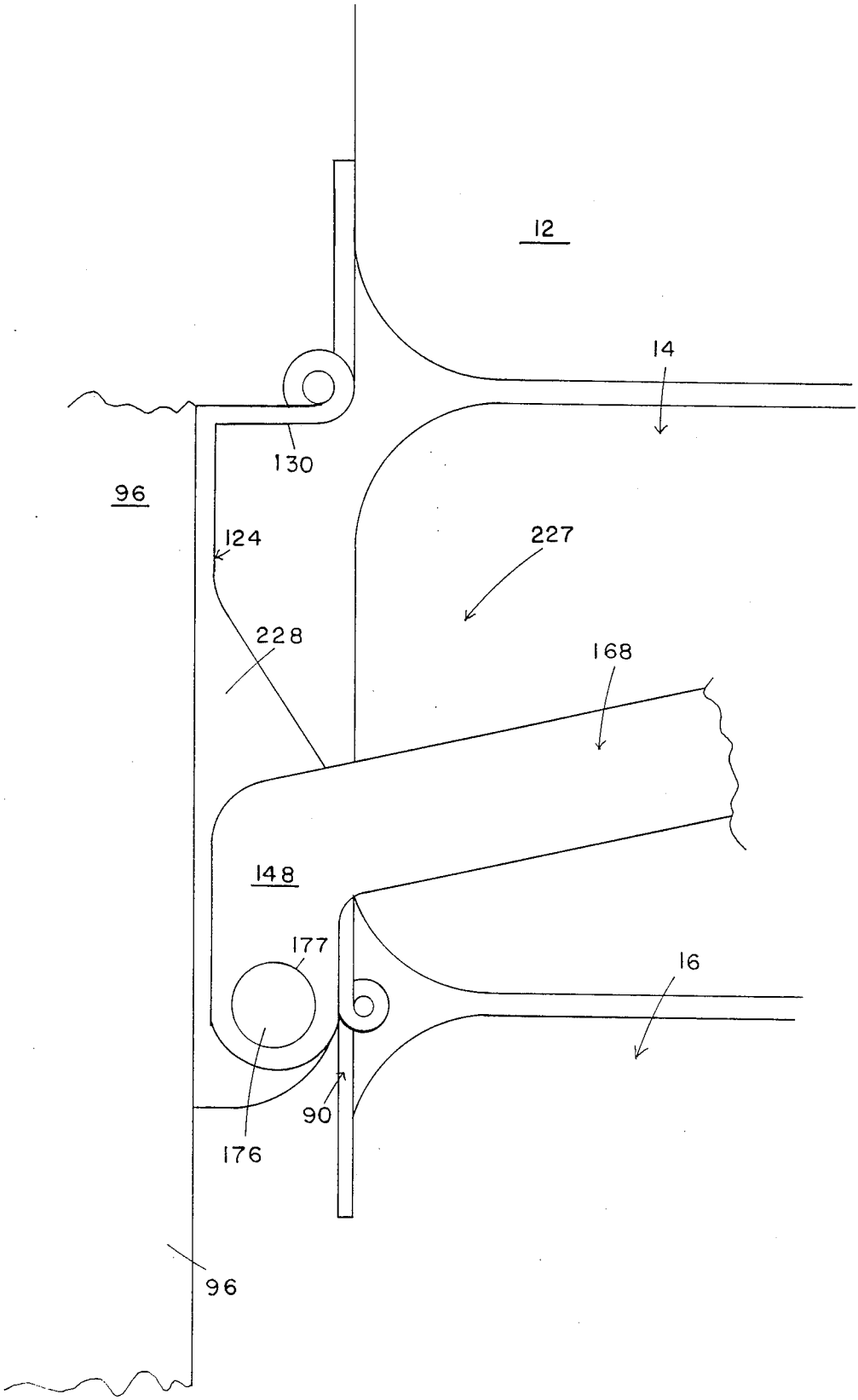
FIG. 5 top plan view of a portion of another mounting system according to invention, showing how the compartments are attached thereto.

Referring to FIG. 5 of the drawing, a further mounting system denoted generally by reference numeral 227 is shown. In such a mounting system, the flange 228 for mounting of lever 168 is of planar configuration and extends perpendicularly outwardly from mounting plate 124 at its top or side edge 136 (FIG. 3(*a*)). The end portion 148 of the elongated lever 168 is connected to shaft 176 according to usual techniques and lies in a plane parallel to that defined by the flange 228. End portion 148 will, of course, be suitably spaced apart from flange 228 so as not to interfere with rotation of shaft 176 when opening and closing the compartments. Although not shown in the drawing, shaft 176 will extend downwardly through an opening provided in flange 228, and hence through a flange located at the other end thereof and connect with elongated lever 170. The leaves of elongated hinge 90 can be connected to respective compartments 14, 16 by any conventional means, depending upon the construction of the cabinets. Elongated leaf 130 on the mounting plate will, of course, be connected to a matching leaf provided on compartment 12, as earlier disclosed.

Figure 6:
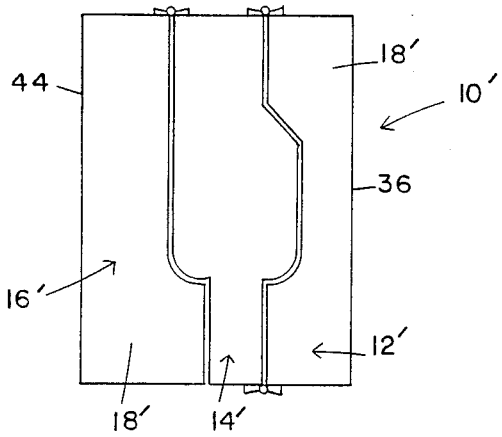
FIG. 6 is a top plan view of another storage unit according to the invention, in which the individual storage compartments are folded into compact position, and in which the individual storage compartments are seen to be non-symmetrical in cross-sectional shape and fit modularly into each other.

The storage compartments of a storage unit in accordance with the invention need not, necessarily, be symmetrical in shape. They can, if desired, be manufactured so as to fit modularly one into the other such as is shown by the storage unit 10' in FIG. 6. As shown in that figure of the drawing, storage unit 10' comprises storage compartments 12', 14', and 16' hinged together the same as are the compartments in FIG. 1. Such a configuration will be able to handle items of different size and shape. Other contours can obviously be manufactured for special applications.

The storage unit 10 and mounting system 118 need not be provided as a complete system ready for installation in an already existing storage area. Instead, if desired, such components can be provided in kit form as an assembly of components to be assembled together by the homeowner or other user depending upon the particular application. Thus, a storage unit kit can be provided in accordance with another aspect of the invention. In this case, the kit can comprise a plurality of already constructed storage compartments, e.g., three, with a plurality of hinges for connecting the storage compartments together as shown in FIG. 1. Further, such a kit will include the mounting system 118 comprising the mounting assembly 120 and linkage system 122 with appropriate instructions for connecting the same to the storage unit and installing the storage unit in the available storage area. If desired, the storage compartments themselves can each be provided in broken down condition into the component parts, to later be assembled together. In this case, the shelving or hanging hardware can readily be located in the storage compartments as desired by the user.

Other modifications and changes, as will be understood, can be made in the invention and in its form and construction without departing from the spirit and scope thereof. The embodiments disclosed herein are merely exemplary of the various modifications that the invention can take and the preferred practice thereof. It is not, however, desired to confine the invention to the exact construction and features shown and described herein, but it is desired to include all such as properly come within the spirit and scope of the invention disclosed.

What I claim is:

1. Mounting system for a space utilizing unit capable of supporting or storing a multiplicity of desired items within a limited space, said unit comprising a plurality of individual members each being capable of supporting or storing multiplicity of separate and distinct items, each said member being defined by elongated, parallel side edges and elongated, parallel, end edges, said members being hingedly connected together along predetermined side edges so as to be foldable into a compact unit capable of fitting into said limited space and unfoldable and extended at predetermined angles relative to one another whereby to provide ready viewing and access to any of said desired items, said mounting system comprising:

(a) a mounting assembly comprising:

(1) a planar, mounting plate defined by elongated, parallel, front and back edges, and elongated, first and second side edges parallel to one another and intersecting said front and back edges, at least two, spaced-apart openings being provided in said plate for location of screw fastening means or the like for mounting of the mounting assembly to a support member, said openings being in alignment with one another and being perpendicularly disposed relative to said side edges mid-way between said front and back edges;

(2) first and second elongated mounting flanges spaced apart from one another and extending perpendicularly outwardly from said mounting plate at respective said first and second side edges a predetermined distance and each terminating in an outer linear edge defined by a plane parallel to the plane defined by said mounting plate, said elongated flanges being parallel to one another and each being defined by a planar main portion disposed in a plane defined by a linear back edge terminating at the back edge of said mounting plate and a front end portion in opposition to said back edge and extending beyond the front edge of the said mounting plate a predetermined distance, at least two spaced apart openings being located in said planar main portion for locating screw fastening members or the like in the mounting of the said mounting assembly to supporting members located adjacent to respective mounting flanges and disposed perpendicular to the support member for the said mounting plate,, and a centrally located opening in each said end portion; and (3) one leaf of an elongated hinge defined by an elongated linear edge and an elongated hinge edge and first and second end edges, said one leaf being connected at its elongated linear edge and end edges to said mounting plate and to said mounting flanges at their respective back edges and extending perpendicularly outwardly from the back edge of the mounting plate, the hinge edge of the said one leaf extending just beyond the outer linear edges of the mounting flanges so that the said hinge edge thereof is free for operative association of the said one leaf with the other, complementary leaf of the elongated hinge and for proper operation of the hinge during use of the mounting system; and (b) a linkage system operatively associated with the said mounting plate for connecting said individual members together whereby such members can be folded into said compact unit or unfolded into the extendable position as desired comprising;

(1) an elongated rod being disposed in a plane parallel to that defined by said one leaf and being located in and being defined by ends extending beyond each said centrally located opening in respective end portions in said mounting flanges a predetermined distance and being capable of rotating in and with respect to each said centrally located opening;

(2) a pair of first, elongated spaced-apart levers in parallel relation to each other, each said lever being disposed perpendicular to said elongated rod and of planar configuration and being defined by a middle portion and an inner end portion and an outer end portion extending from said middle portion at opposite ends thereof, and inner and outer openings being located at and in said outer end portion in predetermined spaced-apart locations; and (3) a pair of second elongated spaced-apart levers in parallel relation to one another, each being defined by first and second ends and an opening being provided in each of said ends one of the pair of first elongated levers being operatively associated at its inner end portion to one end of said elongated rod, and the other of the pair of first elongated levers being operatively associated at its inner end portion to the other end of said elongated rod whereby on rotation of said elongated rod, the said first named elongated levers will be caused to operate in rotatable manner in unison with one another and with said elongated rod, means being provided for operative association in the said inner openings of said outer end portions for pivotally connecting each of said first elongated levers to the respective end edges of a predesignated one of said individual members, means pivotally connecting each of said second elongated levers at one end thereof to a first elongated lever at the said outer opening located therein, and means for pivotally connecting each said second elongated lever at their other ends to the end edges of another predesignated member.

2. Mounting system according to claim 1 wherein the said space utilizing unit comprises a plurality of planar-like individual members, each said member being defined by a front planar surface and a back planar surface, at least one of said surfaces providing a support for the mounting and support of discrete, spaced-apart items.

3. Mounting system according to claim 2 wherein said discrete, spaced-apart items comprise electronic components mounted on at least one of said planar surfaces of each said member and being interconnected together in operative association.

4. Mounting system according to claim 2 wherein a plurality of spaced-apart openings are provided in at least one of the said surfaces of each said planar-like members for location of fastening means for support of the said discrete, spaced-apart items.

5. Mounting system according to claim 4 wherein said planar-like members are in the nature of peg-board and said fasteners are hook like fasteners used in peg-board.

6. Mounting system according to claim 1 wherein the space utilizing unit comprises a plurality of individual members each defining a storage compartment capable of easy access.

7. Mounting system according to claim 6 wherein each said storage compartment is defined by first and second spaced-apart, planar elongated side panels parallel to one another and defined by front and back edges, elongated, spaced-apart, parallel, planar end panels intersecting therewith, and defined by front and back edges terminating in the same plane as the edges of the said side panels, and a back member fixedly attached to the said side and back panels at the said back edges thereof whereby is defined an internal storage cavity.

8. Mounting system according to claim 7 wherein a plurality of spaced-apart, planar, shelf members in parallel relation to one another are provided in the storage cavity of each said storage compartment said shelf members being of predetermined length and defined by first and second ends.

9. Mounting system according to claim 1 wherein said mounting plate is rectangular-shaped.

10. Mounting system according to claim 1 wherein each said mounting flange comprises a planar main portion disposed in an outer plane defined by a linear back edge terminating at the back edge of the said mounting plate and a front edge terminating at the front edge of the mounting plate, and a planar end portion located in an inner plane relative to said outer plane, and a connecting portion connecting said planar main portion and said planar end portion together.

11. Mounting system according to claim 10 wherein the said connecting portion connecting said main and end portions of each said mounting flange is vertically disposed.

12. Mounting system according to claim 1 wherein the said end portion of each said mounting flange is rounded at the end thereof opposite from the said connecting portion.

13. Mounting system according to claim 1 wherein a circular-shaped opening is provided in at least one of the said first named spaced-apart levers, in the said inner end portion, a threaded dead bore is provided in at least one of the ends of the said elongated rod, and at least one elongated, threaded adjusting means is provided which projects through said circular-shaped opening and is threaded into said threaded dead bore.

14. Mounting system according to claim 1 wherein a circular-shaped opening is provided in only one of the said inner end portions of said first named spaced-apart levers, and a threaded dead bore is provided in only one end of the said elongated rod, and the other end of said elongated rod is fixedly secured at its end to the inner end portion of the other of said first named levers.

15. Mounting system according to claim 1 wherein the said first named spaced-apart levers are planar and the said middle portion of each said lever comprises a first elongated portion connected to said inner end portion and a second elongated portion connected to said outer end portion, and said first and second elongated portions are disposed at a predetermined angle relative to one another.

16. Mounting system according to claim 15 wherein the said inner end portion of each said first named elongated lever is disposed in the same plane as that of the said first elongated portion of the said middle portion and is disposed at a predetermined angle thereto.

17. Mounting system according to claim 16 wherein the said outer end portion of each said first named elongated lever is disposed in the same plane as that of the said second elongated portion of the said middle portion and is disposed at a predetermined angle thereto.

18. Mounting system according to claim 16 wherein the said inner end portion is disposed at an angle of approximately 45° relative to the said first named elongated portion of the middle portion.

19. Storage cabinet comprising at least one horizontally disposed storage area defined by vertically upright members wherein a mounting system according to claim 1 is mounted therein and such is used in mounting a storage unit in the said at least one storage area, and the mounting plate of the mounting assembly in said mounting system is fastened to one of the said vertically upright members.

20. Storage cabinet according to claim 19 wherein the said storage unit comprises three distinct, vertically oriented storage compartments, each being defined by a front side and a back side, each said compartment being open at its front side and being defined by vertically upright, spaced-apart, side panels defined by front and back edges in parallel relationship to one another and parallel, horizontally disposed, planar end panels defined by front and back edges and being spaced-apart from one another and intersecting with said side panels at the edges thereof whereby to provide a rectangular-shaped storage compartment defining an internal storage cavity, a back member attached to the said side and end panels at their back edges and being coextensive with the rectangular-shaped storage compartment, one of said storage compartments being hingedly connected along the front edge of a vertically upright side panel to the front edge of a vertically upright side panel of another one of said three storage compartments whereby said one compartment and the said another one of said compartments are foldable front side against front side, and the back edge of the other vertically upright side panel of the said another storage compartment being hingedly connected to the back edge of a vertically upright side panel of the third one of said storage compartments whereby said another storage compartment and said third one of the storage compartments are foldable back member against back member.

* * * * *